US009990854B1

(12) United States Patent
Elmasry et al.

(10) Patent No.: US 9,990,854 B1
(45) Date of Patent: Jun. 5, 2018

(54) UNMANNED AERIAL SYSTEM MISSION FLIGHT REPRESENTATION CONVERSION TECHNIQUES AND TRAFFIC MANAGEMENT SCHEME

(71) Applicant: ROCKWELL COLLINS, INC., Cedar Rapids, IA (US)

(72) Inventors: George Elmasry, San Marcos, CA (US); Benjamin J Haan, Marion, IA (US); Rolf R Stefani, West River, MD (US); James Gary Cooper, Jr., Annapolis, MD (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 211 days.

(21) Appl. No.: 15/070,710

(22) Filed: Mar. 15, 2016

(51) Int. Cl.
*G08G 5/00* (2006.01)

(52) U.S. Cl.
CPC ..... *G08G 5/0039* (2013.01); *G08G 5/0043* (2013.01)

(58) Field of Classification Search
None
See application file for complete search history.

(56) References Cited

U.S. PATENT DOCUMENTS

| | | | | |
|---|---|---|---|---|
| 9,734,723 | B1 * | 8/2017 | Bruno | G08G 5/0039 |
| 2010/0121575 | A1 * | 5/2010 | Aldridge | G08G 5/0069 701/301 |
| 2016/0253907 | A1 * | 9/2016 | Taveira | G08G 5/006 701/3 |

* cited by examiner

*Primary Examiner* — Khoi H Tran
*Assistant Examiner* — Kelly D Williams
(74) *Attorney, Agent, or Firm* — Angela N. Gerdzhikov; Donna P. Suchy; Daniel M. Barbieri

(57) ABSTRACT

A system and method are provided for implementing unmanned aircraft system (UAS) deconfliction schemes by accepting representations of UAS flight plans in disparate native forms, and to converting them into a common format in support of evaluating potential conflicts, and providing flight plan approval/disapproval, and/or flight plan execution restrictions or warnings regarding potentially conflicting manned and unmanned aerial vehicle operations. The disclosed UAS Traffic Management (UTM) scheme may validate a UAS flight plan based on the provided flight plan representation, approving or disapproving the flight plan, and may provide suggestions for modification of a submitted UAS flight plan to enhance operational deconfliction without completely rejecting, through disapproval, the flight plan. Different levels of alerts and/or warnings may be provided to alert the UAS platform operators and National Airspace System operators/controllers to potential conflicts and conflict avoidance.

11 Claims, 4 Drawing Sheets

UNMANNED AERIAL SYSTEM MISSION FLIGHT REPRESENTATION CONVERSION TECHNIQUES AND TRAFFIC MANAGEMENT SCHEME

BACKGROUND

The inventive concepts disclosed herein relate to systems and methods for implementing schemes to accept different and disparate representations of unmanned aircraft system (UAS) flight plans and to convert them into common flight representations usable for evaluating potential conflicts, and for providing one or more of flight plan approval/disapproval, and/or flight plan execution restrictions or warnings regarding potentially conflicting manned and unmanned aerial vehicle operations in a UAS Traffic Management (UTM) scheme.

Potential deployment scenarios involving UAS platform operations are increasing as the technology for local and remote control of UAS platforms of all shapes and sizes increases. Governmental, law enforcement, commercial and other types of entities are becoming increasingly aware of, and progressively more comfortable with, the capabilities and benefits of routinely employing UAS platforms for certain mission types. Current mission employment scenarios include all manner of locally-focused and/or wide area surveillance. These include, for example, power line condition monitoring, and track and rail bed condition monitoring, and myriad law enforcement and environmental surveillance taskings. Proposed mission scenarios include various forms of payload/package delivery, and for example employment in crop dusting.

UAS platforms in use today encompass a broad array of platform sizes, onboard sensor capabilities and payload capacities. These UAS platforms include the comparatively larger and more robust, often military-controlled and operated, unmanned aerial vehicles (UAVs, commonly referred to as drones) that fly (1) under the positive control of a pilot or other operator, often situated in a remote fixed location, (2) autonomously under the control of onboard computers executing pre-loaded mission/flight profiles from takeoff to landing, and (3) hybrid missions in which certain phases of the flight envelope or mission scheme are positively controlled by a remote operator while other phases of the flight envelope or mission scheme are autonomously executed by onboard control components. Others of these UAS platforms include a class of locally, generally line-of-sight operated Small Unmanned Aerial System (sUAS) platforms. Regardless of size or composition, the UAS platforms discussed throughout this disclosure are those that are capable of controlled flight from launch, through in-flight operations, to recovery and/or landing in a manner similar to a conventional piloted airplane or helicopter.

A focus of efforts to support a broader array, and increasing population, of UAS platforms involves the safe integration of all manner of UAS platforms into, for example, the National Airspace System (NAS) of the United States. Operational deconfliction of all aerial platforms is the challenge. Piloted or manned aircraft have the advantage of see and avoid capabilities based on the placement of the pilot in the observation and decision-making loop for operation of the aircraft. Pilots of manned aircraft, whether under positive control in controlled airspace, or operating autonomously in uncontrolled airspace, are ultimately tasked with "seeing" conflicts as they arise, and taking appropriate action, including evasive maneuvering in view of those conflicts. Separately, many manned, as well as certain larger unmanned, aircraft may include sensor suites that may supplement, or effectively replace, see and avoid with certain "sense and avoid" capabilities. These sensor suites provide some level of a proximity monitoring function with regard to other potentially conflicting aerial operations in order that a pilot or other operator may be alerted to the conflict in time to initiate such action as may be appropriate to avoid the conflict.

Simpler, smaller, less expensive, easier-to-operate and less sophisticated UAS platforms are becoming much more prolific. Based on their limited capacity to be autonomously deconflicted from other aircraft operations, it has become of some increased importance to provide external and support schemes for implementing strategies to provide area deconfliction for UAS operations often in one or both of time and space.

Local employment of particularly sUAS platforms to date tends to be generally autonomous. The local operator of the sUAS platform, for example, may be generally unaware of other aerial platform (manned and unmanned) operations in a vicinity of the operations of his or her sUAS. This situation, of course, lends itself to safety of flight considerations in which individual UAS platforms may interfere with the operations of other manned and unmanned aircraft operating in a vicinity of, or passing through an area of operations of, a particular locally-controlled or remotely-controlled UAS platform.

Conventionally, when employing a sUAS platform, a local "pilot" of the sUAS platform may be provided certain rudimentary traffic deconfliction information, but generally is unconcerned with other operations in a vicinity, and certainly does not coordinate, in a current deployment scheme, operations with the operations of other sUAS platform operators in the area. In this regard, the immediate operation of a particular UAS platform may be considered local, tactical employment of the particular platform. This scenario is operationally played out, for example, when one considers that the pilot of the sUAS platform is in a fixed location within line of sight to the sUAS platform operating a joystick based on observed operations of the sUAS platform, potentially augmented by an actual video feed from the sUAS platform displayed on the operator's console to locally control mission employment of the sUAS platform.

Challenges to increasingly expanded employment of certain UAS platforms include (1) lack of effective oversight for deconfliction and mission reprioritization as between multiple locally-operated unmanned vehicles, and (2) effective employment in operating scenarios in which a locus of the surveillance or other operations undertaken by the UAS platforms may not be locally fixed, i.e., is moving in a planned manner along a pipeline or power line under surveillance, or in an unplanned manner across some open area terrain in an evolving law enforcement surveillance scenario.

Factors complicating integration scenarios for UAS platforms in the NAS include the number of different industries seeking to employ UAS platforms (and/or UAVs, as these terms will be interchangeably used throughout this disclosure) in myriad evolving operating schemes. With national standards existing only loosely, each industry seeks to employ its UAS platforms in such a manner as suits that particular industry's needs. Further, each operating entity operates its UAS platforms according to operating capabilities of the various UAS platforms, and the often only limited and/or ad hoc communications capabilities for providing some rudimentary level of coordination between operators. Finally, there is a difficulty introduced by individual, often proprietary, flight and/or flight plan representation schemes for particular UAS platforms, particular UAS operators and/or UAS operating entities, particular UAS manufacturers and/or particular UAS operations support components that may be largely incompatible with those operated by others.

Putting it another way, with the proliferation of UAS platforms in operation, an increasing need has arisen to provide services (such as; situational awareness, tracking, communications and separation assurance) to more and more UAS platform operators, and to do so without particularly constraining those operators or the UAS operating control entities to being required to employ a particular one of myriad available flight and/or flight plan representation schemes. To date, there is virtually no capability to accept multiple/diverse formats of flight plan representations and/or mission information representation to use and share in a consistent manner with other users of services and/or the airspace in a particular region. This includes virtually no capacity by which to effectively communicate, for example, even with local Federal Aviation Administration (FAA) air traffic control facilities for safe separation of operations, and the like.

As the proliferation of UAS platforms expands to a number of beneficial deployment scenarios, it is anticipated that multiple vehicles may be operated in a particular locus of operations to provide increased wide-area surveillance or other targeted and/or redundant monitoring capabilities. The UAS platforms, as noted above, can be remotely controlled/piloted, or they can be autonomously operated according to preloaded flight plan representations. As such, there is a developing need for unmanned vehicle operators to be provided some representative flight plan approval/disapproval and/or operational alerts and/or warnings by which the operators may better coordinate their efforts with other operators where appropriate, and with mission controllers and other agency entities, including for example air traffic controllers, to attempt to ensure safe and deconflicted aerial platform operations.

SUMMARY

In support of increasing aerial safety for UAS platform operations, it would be advantageous to provide systems and methods for converting all-source UAS flight and flight plan representation information between different formats into a common UAS Traffic Management (and communication) scheme, which may be implemented, for example, using cloud-based capabilities.

Exemplary embodiments of the systems and methods according to this disclosure may provide a UAS Traffic Management (UTM) (and/or mission control) scheme that accepts different representations of UAS flight plans and that can convert one representation to another in cases where such conversion may be appropriate to provide a common flight plan representation scheme for further analysis.

Exemplary embodiments may provide a UTM scheme, which may be cloud-based or substantially cloud-based, to convert particular individually-presented flight plan representations into a common frame or format in order that a certain level of deconfliction for safety of flight reasons may be implemented.

In exemplary embodiments, the disclosed system may access known Aircraft Situation Display (ASD) servers with real-time situational awareness data for manned aircraft and certain known unmanned aircraft, as well as ASD and UAV available flight plans and/or flight plan data.

Exemplary embodiments may access different UAS flight plan representations entering the UTM cloud, and convert one UAS flight representation to another in order to form a common frame of reference in a common format and to further support conversion capabilities to provide properly formatted graphical representations of UAS flight plans to some or all operators undertaking operations in a particular region. An objective of such a scheme is to deconflict those operations for safety and other integration purposes.

In embodiments, the disclosed systems may be capable of providing different levels of alerts and/or warnings via the UAS platform control and joint UAS/NAS communication systems to alert the UAS platform operators and the NAS operators/controllers to potential conflicts. In embodiments, an impact on safe operations based on the potential for conflicts including a level of danger associated with each identified conflict may be identified and reported prior to the conflict arising based on available flight planning considerations.

Exemplary embodiments may validate a UAS flight plan based on the provided flight plan representation (i.e., approving or disapproving the flight plan), and may additionally, or separately, provide certain suggestions to a submitted UAS flight plan to enhance or ensure operational deconfliction without a requirement to, for example, completely reject, or disapprove, the submitted UAS flight plan according to the provided representation.

Exemplary embodiments may provide a non-voice communication capability for mission control from a centralized actual or virtual location to generate and transmit flight or plight plan representation approval, disapproval, modification and/or alerts/warnings when assessing a potential operational conflict in co-located or overlapping aerial vehicle (manned or unmanned) areas of operation.

These and other features and advantages of the disclosed systems and methods are described in, or apparent from, the following detailed description of various exemplary embodiments.

BRIEF DESCRIPTION OF THE DRAWINGS

Various exemplary embodiments of the disclosed systems and methods for implementing schemes to accept different and disparate representations of UAS flight plans, and to convert them into common flight representations usable in a UTM scheme for evaluating potential conflicts and for providing one or more of flight plan approval/disapproval, restriction or warning regarding potentially conflicting manned and unmanned aerial vehicle operations, will be described, in detail, with reference to the following drawings, in which.

DETAILED DESCRIPTION

Figure 1:
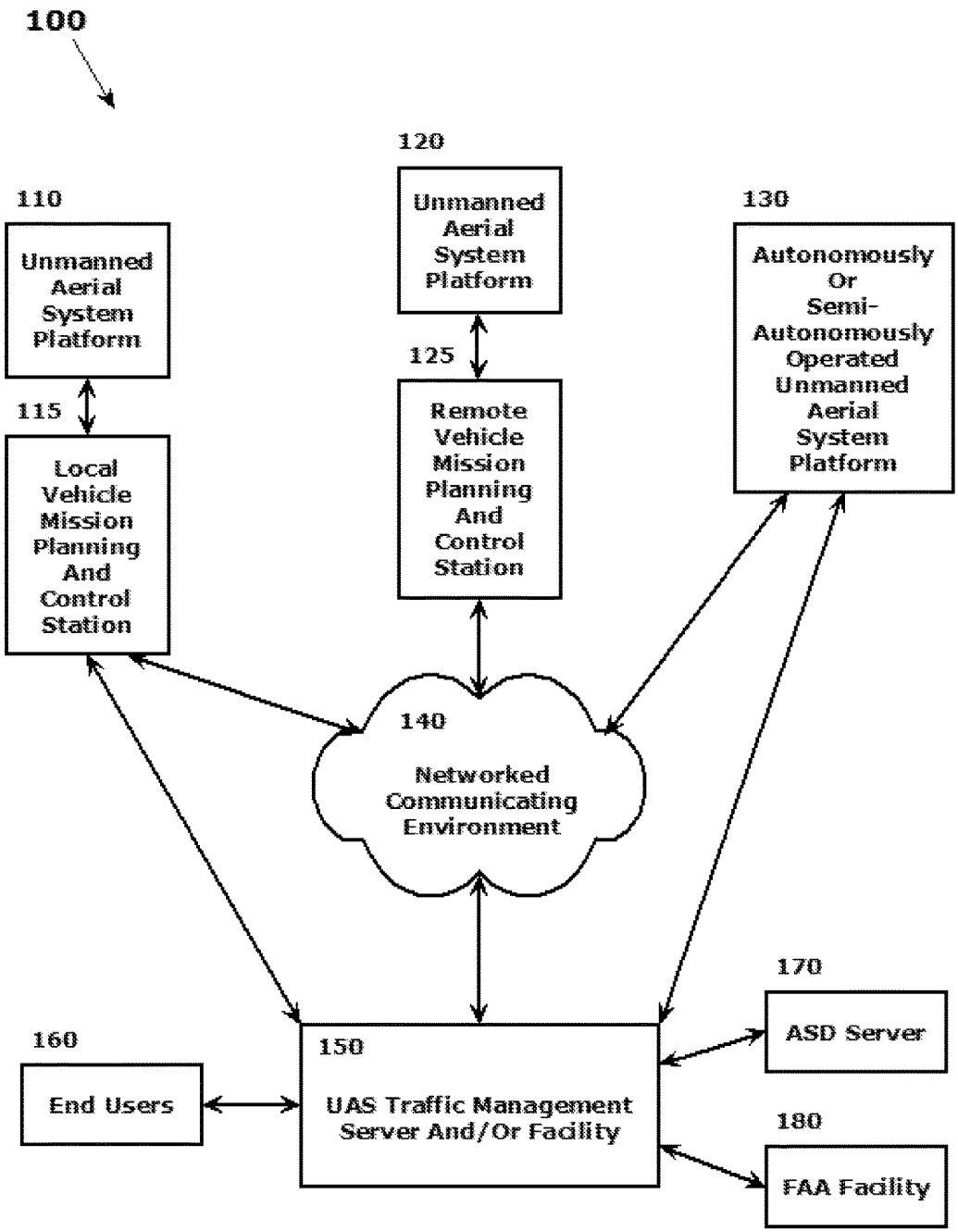
FIG. 1 illustrates an exemplary embodiment of an operating environment with a communication and control network in which an UTM scheme according to the inventive concepts disclosed herein may be implemented.

The disclosed systems and methods for implementing UTM schemes to accept different and disparate representations of UAS flight plans and to convert them into common flight representations usable for evaluating potential conflicts and for providing one or more of flight plan approval/disapproval, restriction or warning regarding potentially conflicting manned and unmanned aerial vehicle operations, will generally refer to these specific utilities for those systems and methods. Exemplary embodiments described and depicted in this disclosure should not be interpreted as being specifically limited to any particular configuration of a UAS platform, or to any particular cooperating communication and control console by which a vehicle operator locally or remotely provides command, control and communication (C3) services to fly the UAS platform. Any advantageous use of an interactive traffic management scheme for integrating UAS fight or flight plan representations regardless of the format submitted to any one of a number of beneficial purposes is contemplated. Further, coordination with available real-time, or near-real-time, information regarding potentially conflicting manned or unmanned aerial vehicle operations in a vicinity of a particular UAS platform operation to provide some level of situational awareness regarding, and operational deconfliction with, other activities in a vicinity of the one or more UAS platforms may be provided.

The disclosed implementation schemes may additionally provide a capacity for some level of control, including approval and disapproval of UAS platform mission planning, coordination and collaboration according to a particular fight or flight plan representation to enhance flight safety associated with UAS platform operations. These schemes may also provide a streamlined representation-based coordination mechanism regarding mission approval, disapproval, alert and/or warning that may enhance deconfliction and safe execution of operations for all involved aerial vehicles in a particular area by introducing a preplanned scheme for reducing potential conflicts in an area surrounding a particular event or occurrence. Any such advantageous use of the systems, methods, processes, techniques, schemes and/or implementations according to this disclosure is considered as being incorporated in the following description of particular exemplary embodiments.

The systems and methods according to this disclosure will be described as being particularly adaptable to employment scenarios for, and configurations of, various UAS platforms and/or UAV's. This focus is not intended to preclude the adaptability of the disclosed systems and methods to beneficial employment by participating manned aircraft in a particular region for coordination with UAS platform operations in the particular region. Further, any reference to a particular employment scenario for a UAS platform, including particularly provision of flight approval information to an sUAS platform operator flying an sUAS platform with a cooperating communication and control console, the operator having visual contact with the platform for substantially all of an event duration, should be understood to be illustrative only in providing a descriptive real-world utility for the disclosed systems and methods, and should not be considered as limiting the disclosed systems and methods in any way.

Additional features and advantages of the disclosed embodiments will be set forth in the description that follows, and in part will be obvious from the description, or may be learned by practice of the disclosed embodiments. The features and advantages of the disclosed embodiments may be realized and obtained by means of the instruments and combinations particularly pointed out in the appended claims.

FIG. 1 illustrates an exemplary embodiment of an operating environment 100 with a communication and control network in which a UTM scheme according to the inventive concepts disclosed herein may be implemented. As shown in FIG. 1, the exemplary operating environment 100 may include a plurality of UAS platforms 110,120,130. Each of the UAS platforms 110, 120, and 130 may be operated according to a particular mission planning and control scheme. For example, the UAS platform 110 may be operated in control of, and in communication with, a local vehicle mission planning and control station 115. The UAS platform 120 may be operated in control of, and in communication with, a remote vehicle mission planning and control station 125. The UAS platform 130 may be autonomously or semi-autonomously operated according to a pre-planned mission scheme that may be uploaded to the UAS platform 130 prior to mission execution.

In all instances, it is envisioned that a representation of a flight plan (for an intended route of flight or area of operation) will be available prior to mission execution. These flight plan representations may be in any format available to the UAS operators or operating entities controlling the various UAS platforms 110, 120, and 130. According to the disclosed schemes, prior to mission execution, such flight plan representations may be communicated to a UAS Traffic Management Server (which may be cloud-based) and/or facility 150 (UTM 150) for review.

Details regarding communication between the UAS mission planning nodes and the UTM 150 will be described in greater detail below with regard to FIG. 2. As a centralized communication and control hub, or a centralized clearinghouse, the UTM 150 may establish two way communications with the various UAS mission planning nodes, each associated directly or indirectly with particular UAS platform(s). Such communications may be direct between the UTM 150 and the mission planning nodes, or may be via some networked communicating environment 140. Additionally, the UTM 150 may communicate with various entities, including all manner of interested parties as end-users 160, an ASD server 170 for access to manned flight information and other operating information that may bear on a particular UAS flight representation, and with various regional or national FAA facilities 180 including those involved in air-traffic control and deconfliction for manned aircraft and other associated aerial operations. In this manner, the UTM 150 may have access to the many diverse data sources housing and/or cataloging real-time information regarding potentially conflicting aerial operations in a vicinity of a particular UAS area of operations for providing UAS flight plan approval, disapproval, restriction, monitoring, alerts and/or warnings.

Although current commercial operations of UAS platforms are generally limited by FAA regulations to operations outside controlled airspace and according to other evolving regulatory schemes, it is envisioned that the capabilities provided by the disclosed systems and methods may increase a potential for safe integration of UAS operations in areas in, under and around of controlled airspace. It is for this reason that communication with regional and national FAA facilities 180 may be appropriate for expanding full implementation of the disclosed schemes. An advantage is that the required computing overhead to (1) assimilate all source data, including flight plan representations in whatever form they are presented, (2) convert the received flight plan representation information into a common format, (3) analyze the translated flight plan representation information against other all source data; (4) make decisions regarding flight representation deconfliction and (5) disseminate information including results of the analysis, and decisions rendered thereon, to all interested entities in a format for direct integration into the systems operated by those entities may be centrally located as a UTM 150 in a cloud-based implementation, or in some physical facility.

Figure 2:
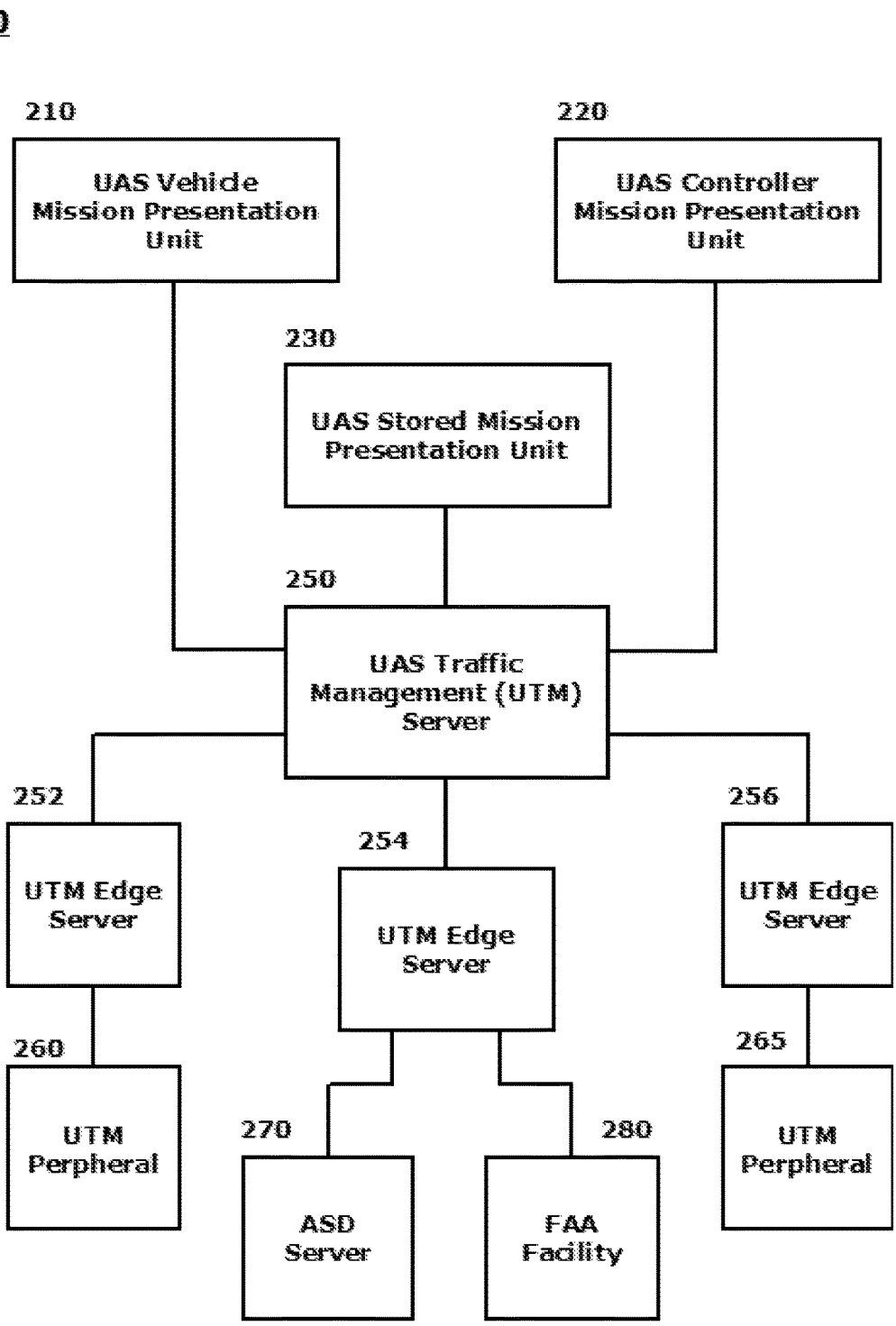
FIG. 2 illustrates an exemplary embodiment of an overview of a UTM system architecture according to the inventive concepts disclosed herein.

FIG. 2 illustrates an exemplary embodiment of an overview of a UTM system architecture 200 according to the inventive concepts disclosed herein. As shown in FIG. 2, the system architecture 200 includes a UTM server 250. In implementations, the UTM server 250 may be in the form of one or more core servers in a UTM cloud-based arrangement. In a like manner to the depiction shown in FIG. 1, the UTM server 250 may establish communication with one or more of a UAS vehicle mission representation unit 210, a UAS controller mission presentation unit 220 and a UAS stored mission presentation unit 230 to obtain, as appropriate, flight plan representations for potential UAS missions to be flown by UAS platforms associated therewith. The one or more core servers comprising the UTM server 250 may be supplemented by a plurality of UTM edge servers 252,254, 256, including UTM cloud edge servers, which may provide support to the UTM server 250 in communicating with myriad UTM peripherals 260,265 and for providing access to, for example, an ASD server 270, and various FAA facilities 280.

When arranged as a UTM cloud-based configuration, the multiple UTM peripherals 260,265 may embody, for example, regional servers. Such regional servers may be configured according to the needs of particular industries operating UAS platforms, may be configured for industry-specific operations in a particular region, or may be configured to assimilate all industry UAS operations data, and specifically flight plan representation information, for a particular region. Regardless of which of these mechanisms, or combinations thereof, may be chosen to create one or more UTM peripherals, the UTM cloud-based configuration is anticipated to have the flexibility to support comparatively large numbers of peripheral servers that may be presented according to any industry, functional or regional separation scheme.

In order to provide the flexibility appropriate to enabling a broadest scope of UAS platform integration and operations, it should be understood that the above-described UTM cloud-based configuration may interact with large numbers of individual operating entities according to a broad spectrum of formats for flight plan representation. Based on the variability in UAS platform configurations and/or classes, UAS mission planning and/or control communication configurations and UAS mission representation configurations, among other considerations, UAS flight plan representations made available to the UTM cloud-based configuration may be presented in a virtually limitless combination of formats. While there may be certain standardization among particular industry users, the disclosed UTM systems and methods are intended to be configured to have a capacity to support the virtually limitless combination of formats that may be presented.

As examples of what can be expected for flight plan representation, consider that crop dusting operations may be able to be represented as a box or a bubble over a particular field or group of fields that will be supported by UAS-based crop dusting operations. On the other hand, package delivery or cargo-type flights may proceed along a particular route of flight similar to those undertaken according to manned aircraft flight plans.

It is an objective of the disclosed systems and methods, among others, to provide a capacity to assimilate the information presented to the UTM server 250 (or the UTM cloud-based configuration) from the myriad UTM peripherals in whatever format those flight plan representations may be provided and to convert the individual UAS flight plan representations to a particular common format or representation scheme for further analysis.

Once converted, the UTM server 250 may analyze the flight plan representation against other potentially conflicting flight plan representations and against other all-source data regarding potentially conflicting aerial operations in a vicinity of a particular planned UAS operation according to a particular flight plan representation. This automated analysis may be usable to evaluate potential conflicts with other airborne operations in a vicinity of the UAS operations according to the received flight plan representation in order to (1) validate (approve/disapprove) particular flight plans; (2) create, for example, a detect-and-avoid scheme for potentially conflicting operations; (3) issue one or more of restrictions/modifications to a particular flight plan as represented, and/or (4) generate alerts or warnings regarding potential conflicts with a particular flight plan as represented. In this manner, integration of the UAS operations according to the flight plan representation, and safety of flight considerations for all involved aerial vehicles operating in a particular vicinity may be enhanced.

UAS flight plan representations may take many and disparate forms. These forms include, but are not limited to those described in the following paragraphs.

For certain localized UAS operations in a particular area certain, the UAS flight plans may be depicted according to a "bubble" representation. The "bubble" according to such a flight plan representation may define (1) a maximum altitude (generally, a height above ground) that the UAS platform may be expected to reach, and (2) a maximum distance from a centroid of an operating area (or controller point). The representation may appear as essentially a half sphere. According to such a flight plan representation, there are generally no associated times stamps, indicating that UAS operations may be conducted within such an area representation (or airspace volume at virtually any time). Typical applicability of such a flight plan representation may include military operations in which military UAVs may be autonomously operated where a military UAS regional server may isolate UAS information from the NAS and validate that no NAS civilian flights (manned or unmanned) will cross within this defined half of a sphere.

For other localized UAS operations in a particular area, the UAS flight plans may be depicted according to a "box" representation. The "box" according to such a flight plan representation may define a specific height over a specifically-bounded geographic area. Industries such as crop dusting or local-area surveillance operations may resort to such a flight plan representation.

For UAS operations that are intended to transit in a particular direction, the UAS flight plans may be depicted according to a "3D waypoints" representation of a UAS flight plan. This waypoint-type representation creates waypoints for the UAS platform to transit along a particular path from an origination point, to a destination point, without specifying the time (or a particular time window) for flying the aerial operations. When such a flight plan is approved, the operator may be authorized to fly the UAS platform at any time of the day as long as the flight adheres to the flight plan waypoints according to an approved representation. Applications for such flight plan representations may include, but not be limited to, utility line and railroad track/track bed inspection where flight times may occur at any time, as may be appropriate, for example, for responding to an emergent situation or occurrence, but flight routing waypoints are fixed and known (e.g., over the railroad track bed or over the utility poles/powerlines).

For even more detailed UAS operations that are intended to transit in a particular direction, the UAS flight plans may be depicted according to a "4D waypoints" representation of a UAS flight plan in which one or more of the waypoints are associated with a particular time stamp). This is similar to a scheme in the previous case, but with the addition of flight time or time associated with one or more, or each, of the waypoints. This flight plan representation may be considered to be most similar in format to the NAS flight plan format and applications associated with such a representation may include, but not be limited to, UAS platforms of various sizes and payloads for unmanned cargo delivery with vehicles that can cross the country and use the air space in a similar manner to manned aircraft.

It should be noted that the exemplary employment scenarios outlined above are intended to be illustrative only without implying any limitation to only such employment scenarios and/or flight plan representations as are enumerated above. Other flight plan representations including, for example, flight plan representations that follow a prescribed closed course, or racetrack-like track, over the ground may be similarly implemented according to the disclosed schemes.

Figure 3:
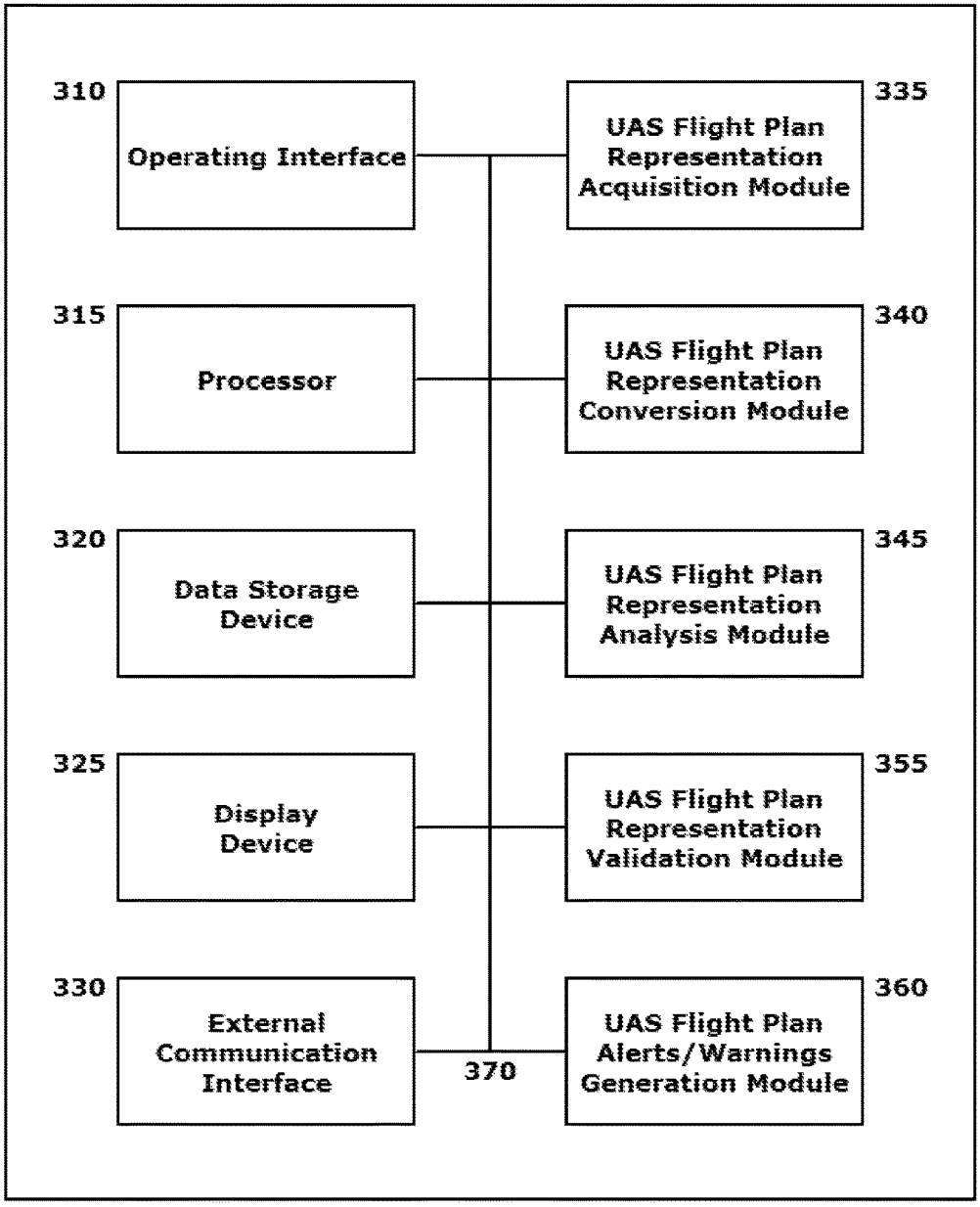
FIG. 3 illustrates an exemplary embodiment of a UTM server system according to the inventive concepts disclosed herein.

FIG. 3 illustrates an exemplary embodiment of a UTM server system 300 according to the inventive concepts disclosed herein. As indicated above, a central server may be in the form of a cloud-based server system communicating with a series of UTM cloud edge servers and UTM cloud peripherals. As such, elements of the UTM server system 300 shown in FIG. 3 may be in a form of actual modules, module functions, or virtual module system components, and in any combination of those as appropriate to the particular devices and/or modules depicted.

The UTM server system 300 may include one or more operating interface(s) 310 by which system commands may be introduced into the UTM server system 300 by one or more users. Such operating interface(s) 310 may be a part, or a function, of a graphical user interface (GUI) mounted on, integral to, or associated with, any UAS platform or a communication and control station associated with any UAS platform. Otherwise, the operating interface 310 may take the form of any commonly-known user-interactive device by which a user input and/or commands are input to an automated processing system for communication and user interaction with UTM server system components (physical or virtual). These commonly-known user-interactive devices may include, but not limited to, keyboards or touchscreens (including those associated with wireless communicating devices), a mouse or other pointing device, a microphone for providing verbal commands, or any other commonly-known operating interface device, including wearable I/O devices.

The UTM server system 300 may include one or more local processors 315 for carrying out the individual operations and functions of the UTM server system 300. The processor(s) 315 may reference, for example, each input UAS flight representation and coordinate server system functions for conversion to a common format, analysis of the flight representation in that common format, validation of the flight plan representation and/or generation of restrictions, alerts and/or warnings associated with the input UAS flight representation.

The UTM server system 300 may include one or more data storage devices 320. Such data storage device(s) 320 may be used to store data or operating programs to be used by the UTM server system 300, and specifically the processor(s) 315 in carrying into effect the disclosed operations and functions. Data storage device(s) 320 may be used to temporarily store information regarding each input UAS flight representation, and appropriate all source data for carrying into effect the analysis and deconfliction schemes with regard to the input UAS flight representations. One or more of the data storage device(s) 320 may be used to store a library of known flight representation formats along with conversion schemes associated with each of the known flight representation formats in order to facilitate the conversion processing to the common format for analysis against the all-source data.

The data storage device(s) 320 may include cloud-based data storage components, or otherwise may be in a form of a random access memory (RAM) or another type of dynamic storage device (actual or virtual) that is capable of storing updatable database information, and for separately storing instructions for execution of system operations by, for example, processor(s) 315. Data storage device(s) 320 may also include a read-only memory (ROM), which may include a conventional ROM device, a virtual ROM or another type of static storage device that stores static information and instructions for processor(s) 315. It is anticipated that the data storage device(s) 320 according to the disclosed schemes may generally be provided external to, and in wireless communication with, other system components. Such configuration does not, however, preclude the physical location of one or more data storage device(s) 320 in, for example, a physical UTM facility. Nor does such a proposed configuration preclude wired communications between system components and one or more of the data storage device(s) 320.

The UTM server system 300 may include at least one display device 325, which may be configured as one or more conventional mechanisms that output information to a user, including, but not limited to, a digital data display screen associated with the UTM system server 300. Such a display device 325 may be provided for a user, for example, to visually evaluate input UAS flight representations, including (1) to ensure a fidelity of the received flight plan representations, (2) to review results of the analysis and validation process undertaken by the UTM server system 300 with regard to any input UAS flight representations and (3) to review, potentially for approval, any outgoing information including flight representation approvals, disapproval s, modifications, restrictions, alerts and/or warnings in an event that it is determined that actual (operator-in-the-loop) user verification may be beneficial and/or required. In embodiments, the display device 325 may provide a graphical depiction of the flight plan representation pre-conversion and/or post-conversion with regard to the common format.

The UTM system server 300 may include one or more external communication interfaces 330 by which the UTM system server 300 may communicate with UAS platforms, UAS operators, UAS operating entities, and all manner of UTM support peripherals (as generally described above), particularly an ASD server and/or FAA/ATC flight information and/or flight control facilities.

The UTM server system 300 may include one or more of a series of particularized UTM implementing modules. Each of the below described modules may be, for example, a physical implementation, a virtual implementation, or a functional implementation, of a particular task undertaken by the UTM server system 300. In this regard, each of these modules may comprise a cloud-based server component or a physical server component as a stand-alone device, or as a function of a more generalized UTM server component, including one or more of the processor(s) 315.

The UTM server system 300 may include a UAS flight plan representation acquisition module 335 that may be usable to acquire separately-formatted UAS flight plan representations according to whatever random format in which those flight plan representations may be received. Such a module may be further usable to identify which random format is associated with the flight plan representation as it is received and to provide such identification information to others of the system components.

The UTM server system 300 may include a UAS flight plan representation conversion module 340 which may be usable to convert the separately-formatted UAS flight plan representations to a common representation scheme of format. Such a module may be further usable to convert any outgoing flight representations to a format that may be directly integrated into a particular flight representation system used by any identified end-user entity that may benefit from being alerted to a particular flight representation in which the entity may have an interest.

The UTM server system 300 may include a UAS flight plan representation analysis module 345 which may be usable to analyze the converted UAS flight plan representations against available all-source data for, for example, potentially conflicting operations in a vicinity of a received UAS flight plan representation in order that particular conflicts with other aerial system operations may be identified.

The UTM server system 300 may include a UAS flight plan representation validation module 350 which may be usable to determine that a particular flight plan according to the received flight plan representation can be approved without modification, can be approved with modification or should be disapproved based on a level of conflicting operations. For these purposes, modifications may include particular time windows within which the specified flight plan representation may be available, or otherwise may not be available, route revisions including particular waypoints to be avoided at particular times or area volume limitations that may constrain, for example, an area over the ground, in a form of a box or a bubble, in which operations may or may not be conducted, or altitude constraints, in a form of maximum altitudes or altitude reservations which should be adhered to in order to limit or remove potential conflicts.

Coincident with, or in addition to, the UAS flight plan representation validation module, the UTM server system 300 may include a UAS flight plan alerts/warnings generation module 360 which may be usable to generate additional information on a pre-planned or real-time basis to enhance operational deconfliction within an area covered by a particular UAS flight plan representation.

As indicated generally above, all of the various components of the exemplary UTM server system 300, as depicted in FIG. 3, may be physical components, virtual components or combinations thereof connected internally within UTM server system 300, or separately and remotely, with each other, via combinations of wired and wireless communication pathways to facilitate data exchange, UAS flight representation acquisition, conversion, analysis, validation and/or restriction, alert and/or warning generation and messaging, and other appropriate information and control data exchange between the various components of the disclosed system.

It should be appreciated that, although depicted in FIG. 3 as a series of separate discrete units with specific operating functionalities, the various disclosed elements of the exemplary server system 300 may be arranged in any combination of sub-systems as individual components or combinations of components, actual or virtual. In other words, no specific configuration is to be implied by the depiction in FIG. 3. Further, although depicted as individual units for ease of understanding of the details provided in this disclosure regarding the exemplary UTM server system 300 components, it should be understood that the described functions of any of the individually-depicted components may be undertaken, for example, by one or more physical or virtual processors within, connected to, and/or in communication with, the separate system components of UTM server system 300.

Figure 4:
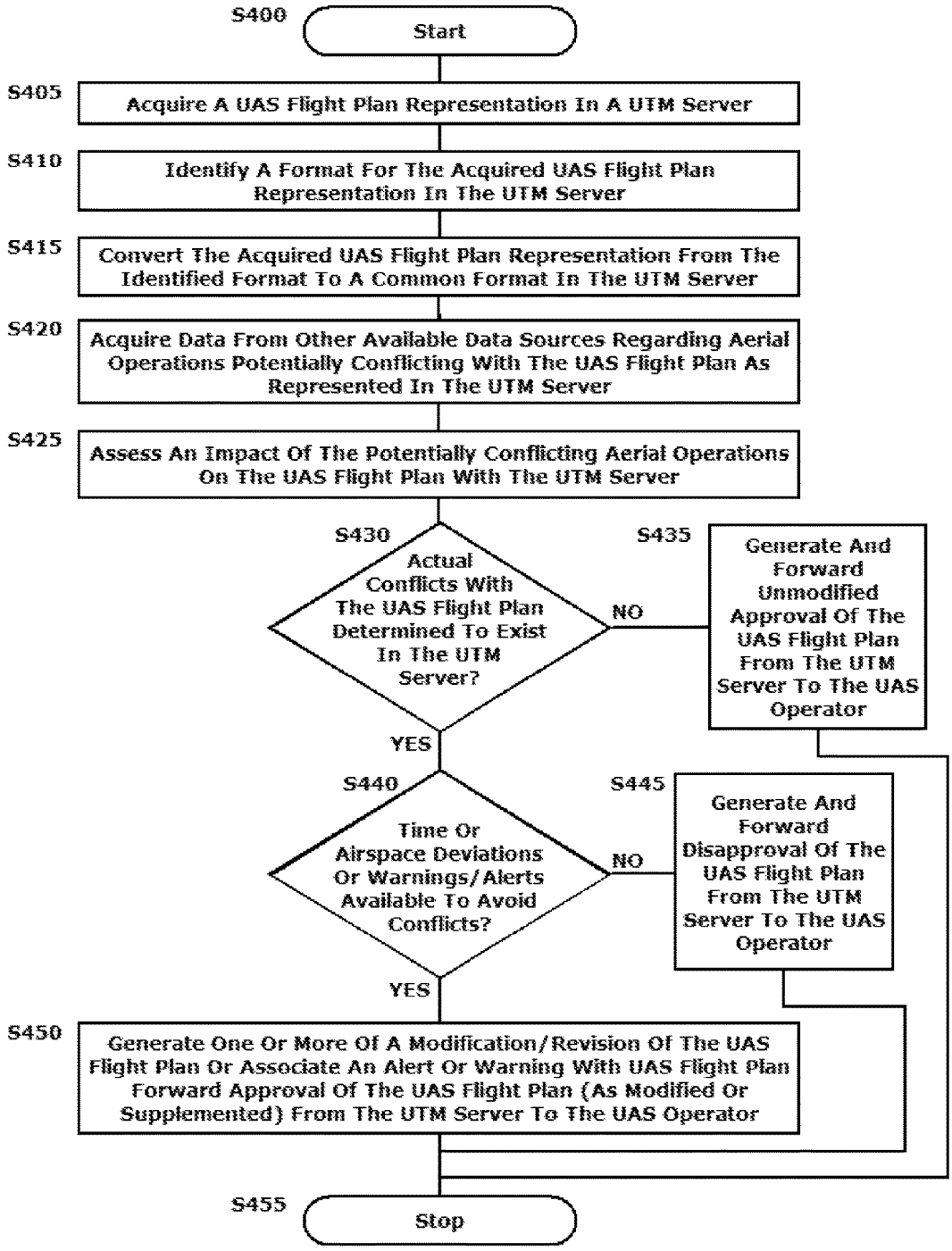
FIG. 4 illustrates a flowchart of an exemplary method for implementing a UTM scheme according to the inventive concepts disclosed herein.

The disclosed embodiments may include an exemplary method for implementing a UTM scheme. FIG. 4 illustrates a flowchart of such a method. As shown in FIG. 4, operation of the method commences at Step S400 and proceeds to Step S410.

In Step S405, a UAS flight plan representation may be acquired (or received) in a UTM server in the manner described above. Operation of the method proceeds to Step S410.

In Step S410, a format for the acquired (or received) UAS flight plan representation may be identified in the UTM server. Operation of the method proceeds to Step S415.

In Step S415, the acquired (or received) UAS flight plan representation may be converted from the identified format in which it was received to a common format usable by the UTM server for flight representation and other source data comparison. Operation of the method proceeds to Step S420.

In Step S420, data from other available data sources regarding aerial operations potentially conflicting with the UAS flight plan, as represented, may be acquired by the UTM server from myriad available data sources regarding aerial operations in a particular region at a particular time. These myriad available data sources may include, for example, an ASD server, and FAA facilities, including your traffic control facilities, on a regional or national basis. Operation of the method proceeds to Step S425.

In Step S425, the UTM server may assess and impact of potentially conflicting aerial operations on the UAS flight plan, as represented. Operation of the method proceeds to Step S430.

Step 430 is a determination step in which the UTM server may determine, or otherwise ascertain, whether an actual conflict exists through automated analysis of the available all source data as compared to the UAS flight plan representation.

If in Step 430, it is determined that no actual conflict exists, operation of the method proceeds to Step S435.

In Step S435, an approval of the UAS flight plan, as represented, may be generated in the UTM server and forwarded to the UAS operator or UAS operating entity for execution. Operation of the method proceeds to Step S455, where operation of the method ceases.

If in Step 430, it is determined that any actual conflict exists, operation of the method proceeds to Step S440.

Step 440 is a determination step in which the UTM server may determine, or otherwise ascertain, whether any timing or airspace control deviations may be applied to avoid the actual conflicts, or whether warnings or alerts may be issued in conjunction with an approval of a UAS flight plan, as represented, to at least provide a UAS operator or UAS operating entity with information appropriate to avoid such conflicts.

If in Step 440, it is determined that no timing or airspace deviations, or warnings or alerts, may be provided that will effectively mitigate against the actual conflicts that have been determined to exist, operation of the method proceeds to Step S445.

In Step S445, a disapproval of the UAS flight plan, as represented, may be generated in the UTM server and forwarded to the UAS operator or UAS operating entity. Operation of the method proceeds to Step S455, where operation of the method ceases.

If in Step 440, it is determined that some timing or airspace deviations, or warnings or alerts, may be provided that will effectively mitigate against the actual conflicts that have been determined to exist, operation of the method proceeds to Step S450.

In Step S450, one or more of the modification or revision of the UAS flight plan, as represented, may be generated in the UTM server and forwarded to the UAS operator or UAS operating entity for execution. Separately, or additionally, alerts or warnings may be generated in the UTM server and associated with the UAS flight plan as it may be forwarded to the UAS operator or UAS operating entity for execution. Operation of the method proceeds to Step S455, where operation of the method ceases.

In executing the above method, a UTM server, which may be in a form of a UTM cloud regional (peripheral) server may need to covert these UAS flight plan representations from one format to another in order to create data for UTM cloud subsystems or external systems to exploit how to make recommendations to the UAS operator, or UAS operating entity, to change the UAS flight plan. A UAS operator or UAS operating entity may request from the UTM cloud an approval for, for example, a box flight plan. A box representation may be determined to cross an ASD flight planned path for a manned aircraft at an operatively relevant altitude. The ASD flight plan may be in the above-mentioned 4D format.

Embodiments of the above method may act on this operating scenario according to one of the following options.

a. The UTM regional server may make a recommendation to the UAS operator to fly in the box, as represented, except for a time interval when the ASD flight crosses the box, i.e., exclusive of an interval of time
b. The UTM regional server may make a recommendation to the UAS operator to fly in the box within an interval of time, only if ASD activities require such an exclusion.
c. The UTM regional server may make a recommendation to the UAS operator that the flight plan box height (maximum altitude) should be reduced at certain times to exclude higher altitude portions of the flight plan box when ASD activities may exist that overfly an upper portion of the box.
d. The UTM regional server may make a recommendation to convert the flight plan from a box into 3-D or 4-D waypoint representation if the industry can accept such representations. It should be understood that this conversion may allow the UTM regional server to deconflict multiple UAS flights within the region to accommodate for high UAS operations volume in the region.

In embodiments, the UTM regional server may approve 3-D flight plan representations while (1) excluding certain time intervals or (2) requiring that certain specific time intervals be adhered to, to allow for large UAS volume and to reduce conflict with ASD flight plans. In like manner, 4-D flight plan representations may be approved with some time shift, if needed or appropriate.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating environments in which the subject matter of this disclosure may be implemented for familiarity and ease of understanding. Although not required, embodiments of the disclosed systems, and implementations of the disclosed methods, may be provided, at least in part, in a form of cloud-based applications, hardware circuits, firmware, or software computer-executable instructions to carry out the specific functions described. The cloud-based applications, hardware circuits, firmware, or software-executable instructions may include individual program modules executed by the one or more processors. Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in integrating operations of multiple UAS platforms with those of manned aircraft in the NAS using many and widely varied system components.

As indicated above, embodiments within the scope of this disclosure may also include computer-readable media having stored computer-executable instructions or data structures that may be accessed, read and executed by one or more processors in differing devices, as described. Such computer-readable media can be any available media that can be accessed by a processor, general purpose or special purpose computer. By way of example, and not limitation, such computer-readable media may comprise RAM, ROM, EEPROM, CD-ROM, flash drives, data memory cards, virtual data components and structures, or other analog or digital data storage devices that may be used to carry or store desired program elements or steps in the form of accessible computer-executable instructions or data structures. When information is transferred or provided over a network or another communication connection, whether wired, wireless, or in some combination of the two, the receiving processor may properly view the connection as a computer-readable medium. Thus, any such connection is properly termed a computer-readable medium. Combinations of the above should also be included within the scope of the computer-readable media for the purposes of this disclosure.

Computer-executable instructions may include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions, or associated data structures, represents one example of a corresponding sequence of acts for implementing the functions described in the steps of the above-outlined exemplary method. The exemplary depicted steps may be executed in any reasonable order to carry into effect the objectives of the disclosed embodiments. No particular order to the disclosed steps of the method is necessarily implied by the depiction in FIG. 4, except where execution of a particular method step is a necessary precondition to execution of any other method step.

Although the above description may contain specific details, they should not be construed as limiting the claims in any way. Other configurations of the described embodiments of the disclosed systems and methods are part of the scope of this disclosure. It will be appreciated that several of the above-disclosed and other features and functions, or alternatives thereof, may be desirably combined into many other different systems or applications. Although the above description may contain specific details, they should not be construed as limiting the claims in any way. Other configurations are part of the scope of the disclosed embodiments. For example, the principles of the disclosed embodiments may be applied to each individual user, UAS operator, UAS flight representation, mission controller and/or other interested party, where each user may individually employ components of the disclosed systems and methods to their advantage. This enables each user to enjoy the benefits of the disclosed embodiments even if any one of the large number of possible applications do not need some portion of the described functionality. In other words, there may be multiple instances of the disclosed systems each processing the content in various possible ways. It does not necessarily need to be one system used by all end users. Accordingly, the appended claims, and their legal equivalents, should only define the disclosed embodiments, rather than any specific example given.

We claim:

1. An unmanned aerial system (UAS) traffic management (UTM) system, comprising:

at least one first communication device that communicates with UAS mission planning elements to obtain representations of UAS flight plans from the UAS mission planning elements;

at least one second communication device that communicates with a plurality of data sources to obtain planned and actual aerial vehicle operation information;

a traffic management device that is programmed to:

convert obtained flight plan representations to a common format for analysis;

compare a particular converted flight plan representation to the obtained planned and actual aerial vehicle operation information to identify potential conflicts;

determine whether a UAS flight plan, based on the particular converted flight plan representation, is approved in view of the identified potential conflicts;

communicate a result of the determination to an operator of a UAS platform associated with the UAS flight plan via the at least one first communication device;

evaluate whether any of the identified potential conflicts present actual conflicts to execution of the UAS flight plan based on the particular converted flight plan representation, the particular flight plan representation specifying a first airspace volume in which a full scope of the UAS flight plan is conducted;

when an actual conflict exists, determine one or more conflict mitigation strategies, the one or more conflict mitigation strategies includes limiting operations according to the UAS flight plan to a second airspace volume within the first airspace volume, the particular flight plan representation being in a form of a box specifying lateral geographic limitations of the box and a maximum altitude that the UAS platform operating according to the UAS flight plan reaches, the one or more conflict mitigation strategies limiting the operations according to the UAS flight plan to the second airspace volume by specifying at least one of a displacement of one or more of the lateral geographic limitations of the box and a limitation less than the maximum altitude specified in the UAS flight plan; and communicate the determined one or more conflict mitigation strategies to the operator of the UAS platform associated with the UAS flight plan via the at least one first communication device.

2. The system of claim 1, the one or more conflict mitigation strategies including limiting operations according to the particular flight plan representation to particular times of day.

3. The system of claim 2, the particular flight plan representation including a plurality of waypoints, the particular times of day specifying individual time windows where overflight of a particular one or more of the plurality waypoints is disapproved.

4. The system of claim 2, the particular flight plan representation including a plurality of waypoints and a first time of day at which the UAS platform passes at least one of the plurality of waypoints according to the UAS flight plan, and the particular times of day being represented as a time shift applied to the first time of day to specify a second time of day at which the UAS platform passes the at least one of the plurality waypoints.

5. The system of claim 1, the determined one or more conflict mitigation strategies comprising generating a warning message regarding the determination that an actual conflict exists, the traffic management device communicating the generated warning message the operator of the UAS platform associated with the UAS flight plan via the at least one first communication device.

6. The system of claim 1, the plurality of data sources including at least one of an Aircraft Situation Display server, an air traffic control facility server and a Federal Aviation Administration facility server, and the traffic management device being a cloud-based server component.

7. A method for UAS traffic management (UTM), comprising:

obtaining, by a processor, representations of UAS flight plans from UAS mission planning elements;

converting, by the processor, the obtained flight plan representations to a common format for analysis;

establishing communications with a plurality of data sources to obtain planned and actual aerial vehicle operation information;

comparing, by the processor, a particular converted flight plan representation to the obtained planned and actual aerial vehicle operation information to identify potential conflicts;

determining, by the processor, whether a UAS flight plan based on the particular converted flight plan representation is approved in view of identified potential conflicts;

communicating a result of the determination to an operator of a UAS platform associated with the UAS flight plan;

evaluating, by the processor, whether any of the identified potential conflicts present actual conflicts to execution of the UAS flight plan based on the particular converted flight plan representation, the particular flight plan representation specifying a first airspace volume in which a full scope of the UAS flight plan is conducted;

when an actual conflict exists, determining, by the processor, one or more conflict mitigation strategies, the one or more conflict mitigation strategies includes limiting operations according to the UAS flight plan to a second airspace volume within the first airspace volume, the particular flight plan representation being in a form of a box specifying lateral geographic limitations of the box and a maximum altitude that the UAS platform operating according to the UAS flight plan reaches, the one or more conflict mitigation strategies limiting the operations according to the UAS flight plan to the second airspace volume by specifying at least one of a displacement of one or more of the lateral geographic limitations of the box and a limitation less than the maximum altitude specified in the UAS flight plan; and communicating the determined one or more conflict mitigation strategies to the operator of the UAS platform associated with the UAS flight plan.

8. The method of claim 7, the one or more conflict mitigation strategies including limiting operations according to the particular flight plan representation to particular times of day.

9. The method of claim 8, the particular flight plan representation including a plurality of waypoints, the particular times of day specifying individual time windows where overflight of a particular one or more of the plurality waypoints is disapproved.

10. The method of claim 8, the particular flight plan representation including a plurality of waypoints and a first time of day at which the UAS platform passes at least one of the plurality of waypoints according to the UAS flight plan, and the particular times of day being represented as a time shift applied to the first time of day to specify a second time of day at which the UAS platform passes the at least one of the plurality waypoints.

11. The method of claim 7, the determined one or more conflict mitigation strategies comprising generating a warning message regarding the determination that an actual conflict exists, the method further comprising communicating the generated warning message the operator of the UAS platform associated with the UAS flight plan.

* * * * *